United States Patent [19]

Guim et al.

[11] Patent Number: 4,633,240

[45] Date of Patent: Dec. 30, 1986

[54] LIGHTENED CIRCUIT BREAKER

[75] Inventors: Raul Guim; Aurelio R Guim, both of Coral Gables, Fla.

[73] Assignee: Guim Industries, Inc., Coral Gables, Fla.

[21] Appl. No.: 678,398

[22] Filed: Dec. 5, 1984

[51] Int. Cl.[4] ..... G08B 21/00

[52] U.S. Cl. ..... 340/638; 200/313; 200/315; 335/17

[58] Field of Search ..... 340/638, 639; 200/313, 200/314, 315, 316, 310, 308; 335/17

[56] References Cited

U.S. PATENT DOCUMENTS

| | | | |
|---|---|---|---|
| 4,055,739 | 10/1977 | Piber | 200/315 |
| 4,056,816 | 11/1977 | Guim . | |
| 4,384,180 | 5/1983 | Meijer et al. | 200/316 |
| 4,479,170 | 10/1984 | Richardson | 200/315 X |

*Primary Examiner*—James L. Rowland
*Assistant Examiner*—Daniel Myer
*Attorney, Agent, or Firm*—Jesus Sanchelima

[57] ABSTRACT

An improved circuit breaker with overload condition illuminated indicator having a secondary switch coupled to the movement inherent in conventional circuit breaker levers. The improved circuit breaker is self-powered with batteries thereby insulating itself from possible power failures.

4 Claims, 4 Drawing Figures

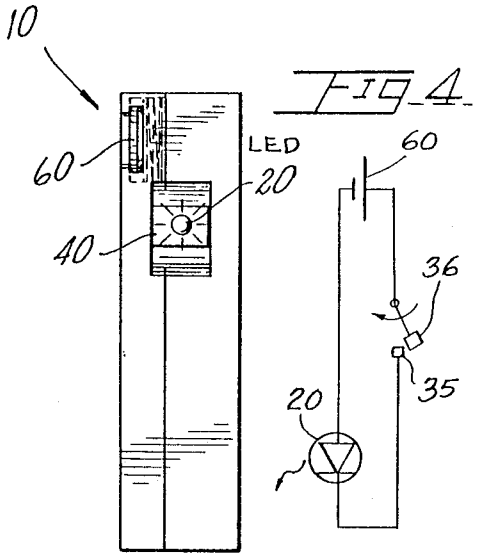
FIG. 4.
FIG. 3.
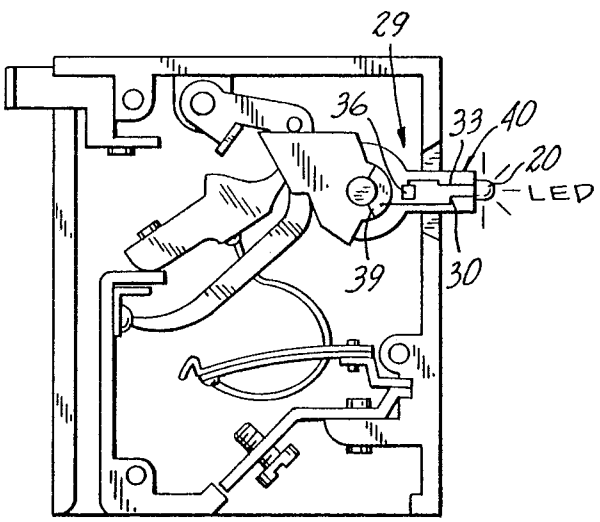
FIG. 2.
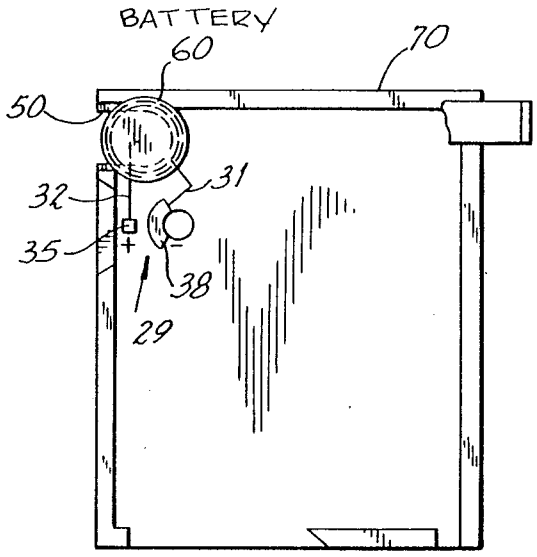
FIG. 1.

LIGHTENED CIRCUIT BREAKER

BACKGROUND OF THE INVENTION

1. Field of the Invention

The present invention relates to improved lighted circuit breakers.

2. Description of the prior art

Applicant believes that the closest reference corresponds to U.S. Pat. No. 4,056,816, issued to the inventor herein. However, it differs from the present invention because it provides for an indicator for overload that is fed from the line that is protecting. Here, the overload indicator is self-powered and utilizes the inherent movement of the conventional circuit breaker for activation.

Other patents describing the closest subject matter provide for a number of more or less complicated features that fail to solve the problem in an efficient and economical way. None of these patents suggest the novel features of the present invention.

SUMMARY OF THE INVENTION

It is the main object of the present invention to provide an improved circuit breaker that lights up an indicator when an overload condition activates it.

It is another object of this invention to provide an overload indicator device that is activated by the conventional circuit breaker mechanism.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents the inner wall of the cover of the improved circuit breaker.

FIG. 2 shows the mechanism of the improved circuit breaker in overload position (lever at center position).

FIG. 3 illustrates the front of the improved circuit breaker.

FIG. 4 is a schematic representation of the circuit of the invention.

DETAILED DESCRIPTION OF THE PREFERRED EMBODIMENT

Referring now to the drawings, where the improved circuit breaker is generally referred to by numeral 10, it can be observed that it looks in all respects like a conventional circuit breaker with the exception of LED device (light emitting diode) 20, a secondary switch assembly 29 including conductor members 30 and 33 on lever 40, battery slot 50 and battery 60.

In FIG. 1, the inside of cap 70 is shown with conductor member 31 illustrated. In the preferred embodiment conductor members 30 through 33 are laminated conductors, like the ones used in printed circuit boards. Conductor members 31 and 32 are attached to the inside wall of cap 70 and terminating on pad 35 which is slightly lifted off the inside wall so that sufficient spring action is provided against pad 36 thereby insuring a good electrical contact. The other end of conductor 32 is connected to the positive electrode of battery 60.

Conductor 31 runs upwardly attached to the inside of the inner wall of cap 70 and it is connected on one end to contact 38 which is permanently in electrical contact with contact 39. LED device 20 makes permanent contact, on one of its two leads, through conductor member 30 with contact member 39 which in turn is always in contact with the negative electrode of battery 60 through contact 38.

The other lead of LED device 20 is connected through conductor 33 to pad 36 which comes to physically coincide with pad 35 when circuit breaker 10 is in overload position thereby closing the electrical circuit and lighting up LED 20. LED 20, in the preferred embodiment, includes an integrally built-in current limiting resistor.

Battery 60 is housed within circuit breaker 10 and can be easily inserted and taken through slot 50. In order to extend the life of battery 60, a conventional multivibrator may be used to reduce the duty cycle of the pulse driving the LED or any other lighting device. Also, the lighted indicator may be intermittent, that is a driving signal may be sent to LED 20 every 1 or 2 seconds instead of providing a continuous signal. For this, a conventional intermattent circuit with the proper timing elements is needed.

The user may test the illuminated indicator circuit by switching the circuit breaker from the ON to OFF position and observing LED 20 lighting up.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. An improved circuit breaker including a three position switch assembly and having an illuminated overload indicator, the improvement comprising:

A. battery means mounted on said circuit breaker;

B. secondary switch means activated by the movement of the lever of said circuit breaker so that said secondary switch means is closed when said lever is in the conventional overload position and open in the other two positions; and C. conductor means mounted on said circuit breaker and connecting said battery to said indicator having said secondary switch means in series so that the circuit may be interrupted and reestablished thereby illuminating said indicator when an overload condition occurs.

2. The device set forth in claim 1 wherein said secondary switch means includes one laminated conductor mounted on said lever cooperating with another laminated conductor on the inside of the cap of said circuit breaker so that both of these conductors physically coincide when said lever is in the overload position.

3. The device set forth in claim 2 wherein said lever includes an end and said indicator means includes an LED device mounted on the end of said lever.

4. The device set forth in claim 3 further including a battery compartment housed within said circuit breaker and said conductor means further including cooperating mating contact pads completing the circuit of said conductor means.

* * * * *